US009398788B2

(12) United States Patent
Dong

(10) Patent No.: US 9,398,788 B2
(45) Date of Patent: Jul. 26, 2016

(54) METHOD FOR MEASURING INSIDE DIMENSIONS OF SHOES AND MEASURING TOOL THEREFOR

(71) Applicant: Xin Dong, Beijing (CN)

(72) Inventor: Xin Dong, Beijing (CN)

( * ) Notice: Subject to any disclaimer, the term of this patent is extended or adjusted under 35 U.S.C. 154(b) by 0 days.

(21) Appl. No.: 14/411,529

(22) PCT Filed: Jul. 1, 2013

(86) PCT No.: PCT/CN2013/000811

§ 371 (c)(1),
(2) Date: Dec. 29, 2014

(87) PCT Pub. No.: WO2014/000426

PCT Pub. Date: Jan. 3, 2014

(65) Prior Publication Data

US 2015/0157094 A1 Jun. 11, 2015

(30) Foreign Application Priority Data

Jun. 29, 2012 (CN) ..... 2012 1 0225317

(51) Int. Cl.
*A43D 1/06* (2006.01)
*A43D 1/02* (2006.01)

(52) U.S. Cl.
CPC ... *A43D 1/06* (2013.01); *A43D 1/02* (2013.01)

(58) Field of Classification Search
CPC ..... A43D 1/06; A43D 1/02; A43B 13/42
USPC ..... 33/3 R, 4, 5, 6
See application file for complete search history.

(56) References Cited

U.S. PATENT DOCUMENTS

| | | | | | |
|---|---|---|---|---|---|
| 373,886 | A * | 11/1887 | Delander | A43D 1/02 | 33/3 R |
| 451,552 | A * | 5/1891 | Damer | A43D 1/02 | 33/3 R |
| 2,362,378 | A * | 11/1944 | Holbrook | A43B 13/42 | 36/30 R |
| 7,343,691 | B2 * | 3/2008 | Long | A43D 1/06 | 33/3 R |
| 8,763,261 | B1 * | 7/2014 | Kemist | G06Q 30/06 | 33/3 R |
| 2015/0157094 | A1 * | 6/2015 | Dong | A43D 1/02 | 33/6 |

* cited by examiner

*Primary Examiner* — Yaritza Guadalupe-McCall
(74) *Attorney, Agent, or Firm* — Na Xu; IPro, PLLC

(57) ABSTRACT

Disclosed is a method for measuring inside dimensions of shoes. In this method a foot model can be obtained after the processes of a plastic filling material being filled into the shoe, shaping, being taken out from the shoe and being restored; then more accurate data of the inside dimensions of the shoe can be obtained by measuring the foot model. Further disclosed is a measuring tool able to be used in the present measuring method. By using the measuring method and the measuring tool, errors encountered when going shopping for shoes can be reduced to the maximum degree by a simple operation, such that the problem that an ordinary consumer could buy a pair of perfect fitting shoes only if he/she tries them personally can be solved.

10 Claims, 1 Drawing Sheet

METHOD FOR MEASURING INSIDE DIMENSIONS OF SHOES AND MEASURING TOOL THEREFOR

This application is a national stage application of PCT application PCT/CN2013/000811 filed on Jul. 1, 2013, which is based on and claims priority to Chinese patent application 201210225317.6 filed on 29 Jun. 2012 and Chinese divisional patent application 201310193947.4 of 201210225317.6 in China. The entirety of each of the above-mentioned applications is hereby incorporated by reference herein in its entirety.

FIELD OF THE INVENTION

The invention relates to a method for measuring dimensions of apparel products, and more particularly to a method for measuring dimensions of shoes and a measuring tool therefor.

BACKGROUND OF THE INVENTION

In recent years, shopping online has been developing rapidly and brings people much convenience. However, when shopping online, the users do not try on the shoes personally but just choose the shoes on the basis of existing shoe sizes (foot length) and shoe types (foot width), so that the shoes purchased from internet are not often fitted or comfortable. In addition, there is also the same problem when buying shoes for others, for example, to show filial piety, sons or daughters working far away from home would like to buy shoes for their parents, but it is often difficult to select an appropriate commodity in accordance with the existing shoe sizes.

In view of the above-described problems, the invention provides a method for measuring inside dimensions of a shoe and a measuring tool therefor, which, just by simple operations, minimizes the size error resulting from the shopping online and helps consumers purchase fitted shoes without trying on them personally.

SUMMARY OF THE INVENTION

One objective of the invention is to provide a method for measuring inside dimensions of a shoe. The method features simple operations, can truly reproduce the dimensions and shape of the inner space of a shoe, and minimize the measurement error.

It is another objective of the invention is to provide a measuring tool for the above mentioned measuring method. The measuring tool can measure the inner dimensions of a shoe conveniently, quickly, and accurately.

The objectives of the invention are achieved by the following technical solutions.

The invention provides a method for measuring inside dimensions of a shoe, comprising the following steps:

1) Preparation of a Filling Material packaging a plastic solid material at room temperature using a layer of cover material whereby yielding a filling material, the filling material having a volume of 20-120 cm3.

The cover material being a breathable, thin, and elastic membraneous or mesh material, preferably, a mesh material; the plastic solid material at room temperature being selected from the group consisting of glutinous rice paste, dough, glue ball, plasticine, cement, or medical barium meal, preferably, plasticine, because the dried plasticine can be recycled after being mixed with water;

2) Filling employing one or more pieces of the filling material obtained in step 1) to fill the shoe tightly, the filling material being added in order along a long axis direction of the shoe when two or more pieces of the filling material are employed, squeezing each piece of the filling material to enable the filling material tightly against an inner surface of the shoe, wherein an ankle position of the shoe is filled with a whole filling material, and after the filling, the filling material is higher than an opening of the shoe and a marker corresponding to the opening of the shoe is marked on the filling material;

3) Shaping drying and shaping the filling material filled in the shoe in step 2), the shaped filling material presenting no deformation upon pulling and drawing the cover material, and not adhering to the inner surface of the shoe;

4) Taking Out and Restoring taking out the shaped filing materials in step 3) from the shoe, and combining the filling materials according to their orders inside the shoe, whereby obtaining a foot model adapting to restore an inner space of the shoe;

5) Measuring measuring dimensions of key parts of the foot model obtained in step 4) according to different types of shoes.

The dimensions of key parts of the foot model vary in different types of shoes, which, in general, comprise a foot length (it is an effective length as far as a pointed shoe is concerned), a thenar width, a height of great toe tip, a great toe length, a instep height, a widest thenar perimeter, an ankle perimeter, a crus perimeter, a shoe upper height, or a mixture thereof. For example, for high boots, the dimensions of key parts comprise a foot length (it is an effective length), a instep height, a thenar width a widest thenar perimeter, an ankle perimeter, and a crus perimeter; for open-toed shoes (piscine mouth shoes), the dimensions of key parts comprise a foot length, a total width of toes, a thenar width, and a widest thenar perimeter; for strappy sandals, the dimensions of key parts comprise a thenar width and a widest thenar perimeter; for sport shoes, the dimensions of key parts comprise a foot length, a height of great toe tip, a instep height, and a shoe upper height; for high-heeled shoes, the dimensions of key parts comprise a great toe length, a foot length, a thenar width, a widest thenar perimeter, and a height of great toe tip.

In this invention, the dimensions of shoes are defined as follows.

A foot length generally refers to a length of a foot model; it should be noted that, for pointed shoes, the length is an effective length excluding the length of the tip of the shoes.

A thenar width refers to a width of the widest part of the sole of a foot model.

A widest thenar perimeter refers to a circumference of the widest part of the sole of a foot model.

A height of great toe tip refers to a height of a position corresponding to the great toe of a foot model. The position corresponding to the great toe of a foot model can be determined as follows: beginning from the lower edge of the heel of the foot model, along the inner side of the foot model, go through a distance which is equivalent to the length of the shoe and then reach a point of the front part of the foot model.

A great toe length is mainly directed to women high-heeled shoes, which refers to a length of the sole of the shoe model contacting the ground.

A instep height refers to a vertical height between a rear edge of a shoe face of a shoe model and a sole of the foot model.

An ankle perimeter is a circumference of a position of a foot model where a marker corresponding to the shoe opening is made. For high boots, it is a circumference of the ankle position.

A crus perimeter is mainly directed to high boots, which refers to a circumference of the thickest part of the crus of a foot model.

A shoe upper height is directed to shoes with upper other than high boots, which refers to a vertical height between a marker of a foot model corresponding to a shoe opening and a bottom of the foot model.

For pointed shoes, the effective length of the foot model must be measured. In general, the effective length is a numerical range, which can be measured according to following method:

According to the length of the shoe, find a first lever line A in front of and vertical to the lower edge of the heel of the foot model, and measure the width of the first lever line A; find a second lever line B in front of the first lever line A, the second lever line B is 5 mm less than the first lever line A in width; find a third lever line C behind the first lever line A, the third lever line C is 5 mm larger than the first lever line A in width; separately measuring a vertical distance between the second lever line and a lever line passing through the lower edge of the heel of the foot model, and a vertical distance between the third lever line and a lever line of the lower edge of the heel of the foot model, whereby obtaining the numerical range of the effective length of the pointed shoes. The distances between the lever lines A, B, and C and the lower edge of the heel of the foot model are measured by a flexible rule tightly against the sole of the foot model.

The cover material in step 1) is an elastic fibrous mesh having a pore size of more than 20 meshes, preferably, a silk stocking having a pore size of more than 80 meshes.

In step 2), the number of the piece of the filling material is determined by areas of a shoe face, a shoe upper, and a shoe heel. For example, children's shoes often require 1-5 pieces of the filling material, adult women's shoes require 2-18 pieces, lady's strappy sandals require 2-5 pieces, lady's mid-cut boat shoes require 4-6 pieces, lady's high boots require 10-18 pieces, lady's high boots are seen as a kind of high-cut shoe; slippers requires only one piece to fill the lower part of the shoe face. Different parts of a shoe can be filled with different sizes of filling materials.

In step 2), when boat shoes/boots or high-cut shoe/boots are measured, after the filling, the filling material at the opening of the shoe is at least 0.5 cm higher than the opening of the shoe.

In step 4), the taking out and restoring of the filling materials refers to fixing the collected filling materials, for example, by bonding. Thus, the obtained foot model adapting to restore the inner space of a shoe is a stable entirety free from the influence of displacement and deformation, thereby being beneficial to the subsequent measurement.

In step 5), the dimensions of foot model are measured using existing tools and methods. Preferably, the ankle perimeter, a widest thenar perimeter and a crus perimeter are measured using a flexible rule, and non-circumference dimensions are measured using a following measuring tool.

The measuring tool comprises three long strip scales a, b, and c having the same width and thickness, one end of each of the long strip scales a, b, and c comprises slender through holes a1, b1, and c1, respectively; the slender through holes are parallel to a long side of the long strip scales; a length of the through holes a1 and b1 is equal to a width of the scales a, b, and c; a length of the through hole c1 is 2-4 times the width of the scales a, b, and c; a width of the though holes a1, b1 and c1 is equal to a thickness of the scales a, b, and c; and graduations of the scales a, b, and c are accurate within millimeter.

The long strip scales a, b, and c are made of materials whose strength can meet the requirements for inserting, sliding and rotating, such as glass, resin, plastics, hard paper, and metals.

The long strip scales a, b, or c is used alone or combined by inserting one into another. For example, the long strip scale a is first inserted into the through hole b1 to yield a slidable scale; the other end of the scale a is insert the through hole c1 to yield a three-dimensional slidable scale capable of measuring dimensions in different planes. The combination of the scales a and c can measure the dimensions in two non-perpendicular planes through the rotation of the scale a in the through hole c1. The measuring tool of this invention is even applied to measure the dimensions of the foot when the foot hanging in the air.

In the method of this invention, the shape of the plastic filling material is adapted to the changes of the internal shape of the to-be-measured shoes. Once the filling materials are shaped, the shape of the internal space of the shoe can be regenerated by the shaped filling materials. Thus, the method can accurately measure the internal dimensions without destroying the structure of the shoes. In addition, the measuring tool of the invention can measure the different internal dimensions of different shoes accurately and quickly.

In practice, a shoe salesman first measures the internal dimensions of the shoes for sale using the measuring method and measurement tool, and then informs the data of consumers. The consumers measure the internal dimensions of the feet of the shoe users using the same measuring method and measurement tool, and then compare the two groups of data to select fitted shoes. Thus, the users can select the fitted shoes without presenting themselves on the shopping place, thereby greatly improving the purchasing efficiency and accuracy, and reducing the shopping costs.

a, b, and c represent three scales, a1 is a through hole disposed on the scale a, b1 is a through hole disposed on the scale b, and c1 is a through hole disposed on the scale c. $\alpha$ is an included angle between the scale a and the scale c after the scale a is inserted into the through hole c1.

DETAILED DESCRIPTION OF THE EMBODIMENTS

Example 1

Figure 1:
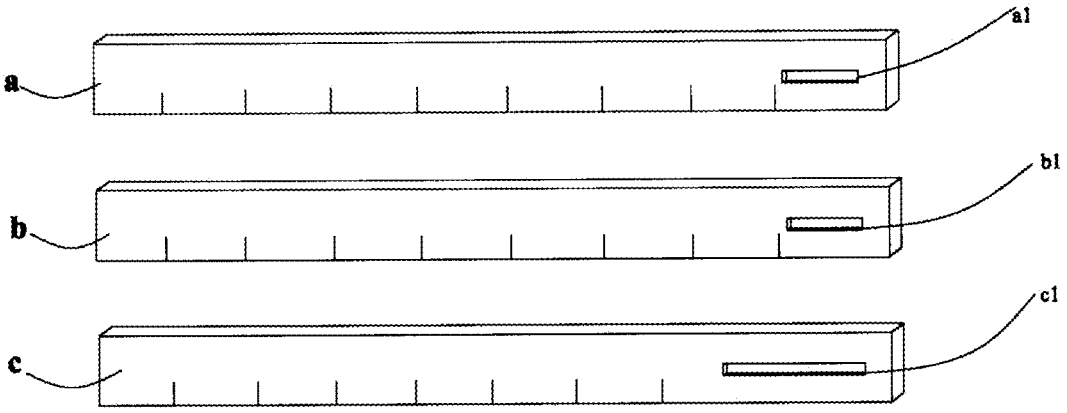
FIG. 1 is a schematic diagram of a measuring tool for measuring foot dimensions in Example 1 of the invention.

As shown in FIG. 1, a measuring tool of foot dimensions comprises three long strip scales a, b, and c, all of which have the same width and thickness. One end of each of the long strip scales a, b, and c comprises a corresponding slender through hole a1, b1, and c1; each of the slender through holes is parallel to a long side of the corresponding long strip scale; a length of the through holes a1 and b1 is equal to a width of the scales a, b, and c; a length of the through hole c1 is 4 times the width of the scales a, b, and c; a width of the though holes a1, b1 and c1 is equal to a thickness of the scales a, b, and c; and graduations of the scales a, b, and c are accurate within millimeter.

Figure 2:
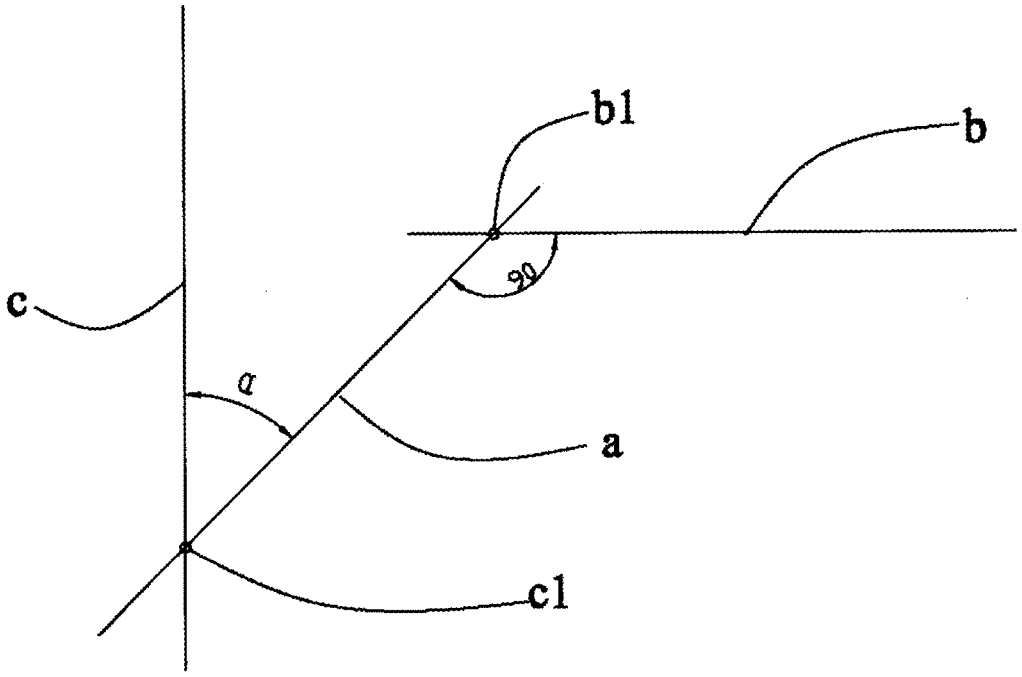
FIG. 2 is a schematic diagram of a three-dimensional slidable measuring tool obtained in Example 1 of the invention.

In use, the long strip scale a, b, or c is used alone or combined by inserting one into another. For example, the long strip scale a is first inserted into the through hole b1 to yield a slidable scale; the other end of the scale a is insert the through hole c1 to yield a three-dimensional slidable scale capable of measuring dimensions in different planes (as shown in FIG. 2). The combination of the scales a and c can measure the dimensions in two non-perpendicular planes through the rotation of the scale a in the through hole c1, and the included angle $\alpha$ of the rotation is between 20 and 160°.

Example 2

A method for measuring inside dimensions of a baby shoe comprises the following steps:

1) Preparation of a Filling Material packaging glutinous rice paste using Nylon stockings having a pore size of more than 100 meshes whereby yielding a filling material, the filling material having a volume of 25 $cm^3$;

2) Filling employing 3 pieces of the filling material obtained in step 1) to fill the baby shoe, squeezing each of the filling materials to enable the filling materials tightly against an inner surface of the shoe, and after the filling, the filling material at the opening of the shoe is 0.5 cm higher than the opening of the shoe;

3) Shaping placing the baby shoe obtained in step 2) in a cool dry place to dry and shape the filling material therein, the shaped filling material presenting no deformation upon pulling and drawing the Nylon stockings, and not adhering to the inner surface of the shoe;

4) Taking Out and Restoring taking out the shaped filing materials in step 3) from the baby shoe, and combining the filling materials according to their orders inside the baby shoe, whereby obtaining a foot model adapting to restore an inner space of the shoe;

5) Measuring measuring dimensions of key parts of the foot model obtained in step 4), comprising a foot length, a thenar width, a widest thenar perimeter and an ankle perimeter. The widest thenar perimeter and an ankle perimeter are measured by a conventional tape measure, and the other dimensions are measured using the measurement tool in Example 1.

Example 3

A method for measuring inside dimensions of a lady's open-toed strappy sandal comprises the following steps:

1) Preparation of a Filling Material packaging plasticine using Nylon stockings having a pore size of more than 80 meshes whereby yielding a filling material, the filling material having a volume of 100-120 $cm^3$;

2) Filling employing one piece of the filling material obtained in step 1) to fill the lady's open-toed strappy sandal, squeezing the filling material to enable the filling material tightly against the shoe face and the inner surface of the shoe bottom, the filling material having a volume of 100-120 $cm^3$;

3) Shaping placing the sandal obtained in step 2) in a cool dry place to dry and shape the filling material therein, the shaped filling material presenting no deformation upon pulling and drawing the Nylon stockings, and not adhering to the inner surface of the shoe;

4) Taking Out and Restoring taking out the shaped filing materials in step 3) from the sandal, whereby obtaining a foot model adapting to restore an inner space of the shoe;

5) Measuring measuring the thenar width of the foot model obtained in step 4) using the measurement tool in Example 1. The widest thenar perimeter is measured by a conventional tape measure.

Example 4

A method for measuring inside dimensions of a lady's high boot comprises the following steps:

1) Preparation of a Filling Material packaging plasticine using Nylon stockings having a pore size of more than 80 meshes whereby yielding a filling material, the filling material having a volume of 100-120 $cm^3$;

2) Filling employing 15 pieces of the filling materials obtained in step 1) to fill the lady's high boot, the filling materials being added in order along a long axis direction of the shoe from the tip to the heel, followed by filling the ankle position using a whole piece of filling material having a volume of 120 $cm^3$, filling the boot upper along a long axis direction from the heel to the shoe opening, squeezing each of the filling materials to enable the filling materials tightly against an inner surface of the shoe, and after the filling, the filling material is 0.5 cm higher than an opening of the shoe;

3) Shaping placing the high boot obtained in step 2) in a cool dry place to dry and shape the filling material therein, the shaped filling material presenting no deformation upon pulling and drawing the Nylon stockings, and not adhering to the inner surface of the shoe;

4) Taking Out and Restoring taking out the shaped filing materials in step 3) from the high boot, and combining the filling materials according to their orders inside the high boot, whereby obtaining a foot model adapting to restore an inner space of the high boot;

5) Measuring measuring dimensions of key parts of the foot model obtained in step 4), comprising a foot length (effective length), a thenar width, a widest thenar perimeter, a height of great toe tip, a instep height, an ankle perimeter, a crus perimeter. The ankle perimeter, a crus perimeter and a widest thenar perimeter are measured by a conventional tape measure, and the other dimensions are measured using the measurement tool in Example 1.

Example 5

A method for measuring inside dimensions of a lady's sport shoe comprises the following steps:

1) Preparation of a Filling Material packaging dough using Nylon stockings having a pore size of more than 80 meshes whereby yielding a filling material, the filling material having a volume of 80-100 $cm^3$;

2) Filling employing 5 pieces of the filling material obtained in step 1) to fill the sport shoe along a long axis direction from the tip to the heel, wherein the ankle and the heel position use a whole piece of filling material having a volume of 120 cm3, squeezing each of the filling materials to enable the filling materials tightly against an inner surface of the shoe, and after the filling, the filling material is 0.5 cm higher than an opening of the shoe, and marking a marker corresponding to the opening of the shoe on the filling material;

3) Shaping placing the sport shoe obtained in step 2) in a cool dry place to dry and shape the filling material therein, the shaped filling material presenting no deformation upon pulling and drawing the Nylon stockings, and not adhering to the inner surface of the shoe;

4) Taking Out and Restoring taking out the shaped filing materials in step 3) from the sport shoe, and combining and boning the filling materials according to their orders inside the sport shoe, whereby obtaining a foot model adapting to restore an inner space of the shoe;

5) Measuring measuring dimensions of key parts of the foot model obtained in step 4), comprising a foot length, a thenar width, a widest thenar perimeter, a instep height, an ankle perimeter, a shoe upper height. The ankle perimeter and a widest thenar perimeter are measured by a conventional tape measure, and the other dimensions are measured using the measurement tool in Example 1.

Example 6

A method for measuring inside dimensions of a lady's high-heeled boat shoe comprises the following steps:

1) Preparation of a Filling Material packaging dough using Nylon stockings having a pore size of more than 80 meshes whereby yielding a filling material, the filling material having a volume of 80-100 $cm^3$;

2) Filling employing 5 pieces of the filling material obtained in step 1) to fill the high-heeled boat shoe along a long axis direction from the tip to the heel, squeezing each of the filling materials to enable the filling materials tightly against an inner surface of the shoe, after the filling, the filling material is 0.5 cm higher than an opening of the shoe, and marking a marker corresponding to the opening of the shoe on the filling material;

3) Shaping placing the high-heeled boat shoe obtained in step 2) in a cool dry place to dry and shape the filling material therein, the shaped filling material presenting no deformation upon pulling and drawing the Nylon stockings, and not adhering to the inner surface of the shoe;

4) Taking Out and Restoring taking out the shaped filing materials in step 3) from the high-heeled boat shoe, and combining and bonding the filling materials according to their orders inside the high-heeled boat shoe, whereby obtaining a foot model adapting to restore an inner space of the shoe;

5) Measuring measuring dimensions of key parts of the foot model obtained in step 4), comprising an effective length, a thenar width, a widest thenar perimeter, a shoe upper height. The widest thenar perimeter and the effective length are measured by a conventional tape measure, and the other dimensions are measured using the measurement tool in Example 1.

The effective length is measured according to the following steps:

According to the length of the shoe, find a first lever line A in front of and vertical to the lower edge of the heel of the foot model, and measure the width of the first lever line A; find a second lever line B in front of the first lever line A, the second lever line B is 5 mm less than the first lever line A in width; find a third lever line C behind the first lever line A, the third lever line C is 5 mm larger than the first lever line A in width; separately measuring a vertical distance between the second lever line and a lever line of the lower edge of the heel of the foot model, and a vertical distance between the third lever line and a lever line of the lower edge of the heel of the foot model, whereby obtaining the numerical range of the effective length of the pointed shoes.

The invention claimed is:

1. A method for measuring inside dimensions of a shoe, the method comprising the following steps:

1) preparation of a filling material packaging a plastic solid material at room temperature using a layer of cover material whereby yielding a filling material, the filling material having a volume of 20-120 $cm^3$, and the cover material being a breathable, thin, and elastic membraneous or mesh material;

2) filling employing one or more pieces of the filling material obtained in step 1) to fill the shoe tightly, the filling material being added in order along a long axis direction of the shoe when two or more pieces of the filling material are employed, squeezing each piece of the filling material to enable the filling material tightly against an inner surface of the shoe, wherein an ankle position of the shoe is filled with a whole filling material, and after the filling, the filling material is higher than an opening of the shoe and a marker corresponding to the opening of the shoe is marked on the filling material;

3) shaping drying and shaping the filling material filled in the shoe in step 2), the shaped filling material presenting no deformation upon pulling and drawing the cover material, and not adhering to the inner surface of the shoe;

4) taking out and restoring taking out the shaped filing materials in step 3) from the shoe, and combining the filling materials according to their orders inside the shoe, whereby obtaining a foot model adapting to restore an inner space of the shoe;

5) measuring measuring dimensions of key parts of the foot model obtained in step 4) according to different types of shoes.

2. The method of claim 1, wherein, the plastic solid material at room temperature is selected from the group consisting of glutinous rice paste, dough, glue ball, plasticine, cement, or medical barium meal.

3. The method of claim 1, wherein, the cover material in step 1) is an elastic fibrous mesh having a pore size of more than 20 meshes.

4. The method of claim 3, wherein, the cover material is a silk stocking having a pore size of more than 80 meshes.

5. The method of claim 1, wherein, in step 2), the number of the piece of the filling materials is determined by areas of a shoe face, a shoe upper, and a shoe heel.

6. The method of claim 1, wherein, in step 2), after the filling, the filling material at the opening of the shoe is at least 0.5 cm higher than the opening of the shoe.

7. The method of claim 1, wherein, in step 4), the taking out and restoring of the filling materials refers to fixing the collected filling materials by bonding.

8. The method of claim 1, wherein, the dimensions of key parts of the foot model measured in step 5) comprise a foot length, a thenar width, a height of great toe tip, a great toe length, a instep height, a widest thenar perimeter, an ankle perimeter, a crus perimeter, a shoe upper height, or a mixture thereof.

9. The method of claim 8, wherein, the ankle perimeter, the widest thenar perimeter and the crus perimeter are measured using a flexible rule, and non-circumference dimensions are measured using a measuring tool; the measuring tool comprises three long strip scales, being first scale (a), second scale (b), and third scale (c), all of which have the same width and thickness, one end of each of the first scale (a), second scale (b), and third scale (c), comprises a corresponding slender through hole, being first through hole (a1), second through hole (b1), and third through hole (c1); each of the slender through holes is parallel to a long side of the corresponding long strip scale; a length of the first through hole (a1), second through hole (b1), and third through hole (c1) is equal to a width of the first scale (a), second scale (b), and third scale (c); a length of the third through hole (c1) is 2-4 times the width of the first scale (a), second scale (b), and third scale (c); a width of the first through hole (a1), second through hole (b1), and third through hole (c1) is equal to a thickness of the first scale (a), second scale (b), and third scale (c); and graduations of the first scale (a), second scale (b), and third scale (c) are accurate within millimeter.

10. The method of claim 9, wherein, foot dimensions of a user are measured using the measuring tool, and compare the foot dimensions of the user with measured inside dimensions of a shoe to select fitted shoes.

* * * * *